US008714899B2

(12) United States Patent
Schuecker et al.

(10) Patent No.: US 8,714,899 B2
(45) Date of Patent: May 6, 2014

(54) APPARATUS ON A COAL-CHARGING LARRY CART FOR LIFTING A LID AND CLEANING A CHARGING HOLE

(75) Inventors: Franz-Josef Schuecker, Castrop-Rauxel (DE); Ralf Knoch, Recklinghausen (DE)

(73) Assignee: UHDE GmbH, Dortmund (DE)

( * ) Notice: Subject to any disclaimer, the term of this patent is extended or adjusted under 35 U.S.C. 154(b) by 344 days.

(21) Appl. No.: 12/812,672

(22) PCT Filed: Jan. 24, 2009

(86) PCT No.: PCT/EP2009/000460

§ 371 (c)(1),
(2), (4) Date: Oct. 20, 2010

(87) PCT Pub. No.: WO2009/097984

PCT Pub. Date: Aug. 13, 2009

(65) Prior Publication Data

US 2011/0030157 A1 Feb. 10, 2011

(30) Foreign Application Priority Data

Feb. 7, 2008 (DE) ..... 10 2008 008 291

(51) Int. Cl.

| | |
|---|---|
| ***C10B 31/04*** | (2006.01) |
| ***C10B 31/02*** | (2006.01) |
| ***C10B 31/00*** | (2006.01) |
| ***C10B 43/04*** | (2006.01) |
| ***C10B 43/02*** | (2006.01) |
| ***C10B 43/00*** | (2006.01) |
| ***C10B 25/14*** | (2006.01) |

(52) U.S. Cl.

CPC ..... *C10B 31/04* (2013.01); *C10B 31/02* (2013.01); *C10B 31/00* (2013.01); *C10B 43/04* (2013.01); *C10B 43/02* (2013.01); *C10B 43/00* (2013.01); *C10B 25/14* (2013.01)

USPC ..... 414/164

(58) Field of Classification Search

CPC ..... C10B 25/08; C10B 25/10; C10B 25/12; C10B 25/20; C10B 25/22; C10B 25/24; C10B 31/00; C10B 31/02; C10B 31/04; C10B 43/02; C10B 43/04; C10B 43/06; C10B 43/08; C10B 43/10

USPC ..... 15/93.1, 93.2; 202/241, 244, 245, 248, 202/262; 414/164, 188, 199, 162, 163, 167, 414/172, 179, 187

See application file for complete search history.

(56) References Cited

U.S. PATENT DOCUMENTS 3,160,573 A * 12/1964 Nepomniashtshy ..... 202/241
3,955,232 A * 5/1976 Konno ..... 15/93.2

(Continued)

FOREIGN PATENT DOCUMENTS

EP 1293552 A 3/2003
EP 1293552 A2 * 3/2003
WO WO 02077122 A1 * 10/2002

*Primary Examiner* — Saul Rodriguez
*Assistant Examiner* — Brendan Tighe
(74) *Attorney, Agent, or Firm* — Andrew Wilford

(57) ABSTRACT

A coal-charging larry cart for lifting lids out of charging holes in the roof of a coke oven and for cleaning the charging-hole jambs has a lid lifter with a lift magnet and a jamb cleaner with a cleaning head. Respective travel frames are horizontally movable on rails on the cart in a first horizontal direction, and respective support frames inside the respective travel frames are each movable relative to the respective travel frame in a second horizontal direction transverse to the first direction. Respective carriages horizontally displaceable in the first direction on the support frames carry the support arms for horizontal movement of each of the support arms relative to the respective support frame between an operating position in which the lift magnet or the cleaning head is aligned with a charging hole in the roof of the coke oven and a rest position spaced from the charging hole.

10 Claims, 1 Drawing Sheet

(56) References Cited

U.S. PATENT DOCUMENTS

| | | | | | |
|---|---|---|---|---|---|
| 4,321,112 | A * | 3/1982 | Galow et al. | ..... | 202/241 |
| 4,515,660 | A * | 5/1985 | Kwasnik et al. | ..... | 202/241 |
| 5,917,600 | A * | 6/1999 | Rongo et al. | ..... | 356/622 |
| 5,941,445 | A * | 8/1999 | Nestler | ..... | 228/119 |
| 6,099,229 | A * | 8/2000 | Knoch | ..... | 414/164 |
| 6,152,668 | A * | 11/2000 | Knoch | ..... | 414/164 |
| 2010/0206710 | A1 * | 8/2010 | Knoch | ..... | 202/241 |
| 2011/0030157 | A1 * | 2/2011 | Schuecker et al. | ..... | 15/93.2 |

* cited by examiner

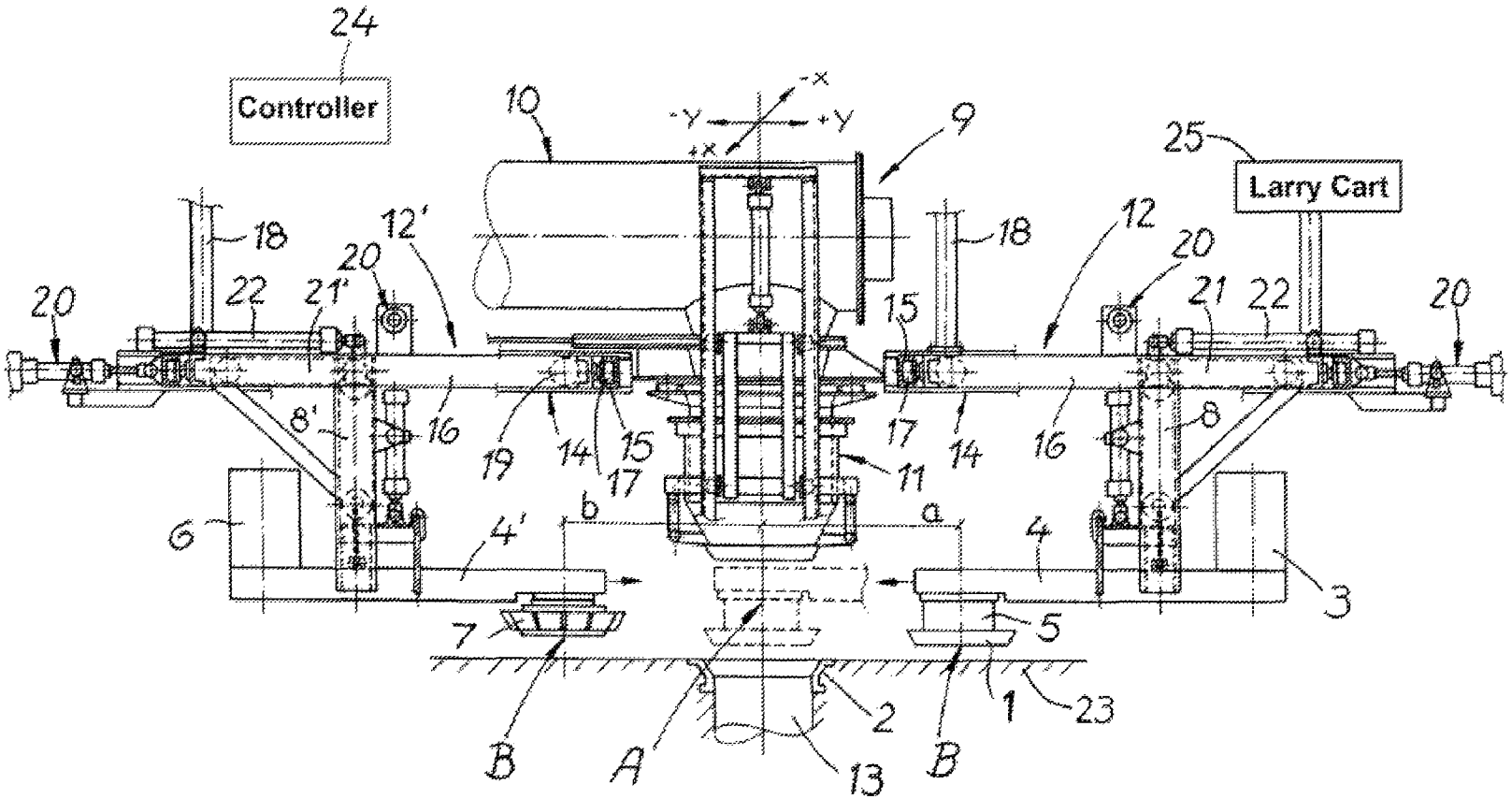
Larry Cart
Controller
+X
-X
+Y
-Y
a
b
A
B
B
1
2
3
4
4'
5
6
7
8
8'
9
10
11
12
12'
13
14
15
16
17
18
19
20
21
21'
22
23
24
25

APPARATUS ON A COAL-CHARGING LARRY CART FOR LIFTING A LID AND CLEANING A CHARGING HOLE

CROSS REFERENCE TO RELATED APPLICATIONS

This application is the US-national stage of PCT application PCT/EP2009/000460, filed 24 Jan. 2009, published 13 Aug. 2009 as 2009/097984, and claiming the priority of German patent application 102008008291.0 itself filed 7 Feb. 2008.

FIELD OF THE INVENTION

The invention relates to an apparatus on a coal-charging larry cart for lifting lids out of charging holes in the roof of a coke oven and for cleaning the charging-hole jambs, the apparatus having a lid lifter having a support arm carrying a lift magnet, a jamb cleaner having a support arm carrying a cleaning head, drives for vertically positioning the support arms, the lid lifter and the jamb cleaner each being mounted on a respective carriage for horizontal movement between an operating position in which the lift magnet or the cleaning head is aligned with a charging hole in the roof of the coke oven, and a rest position spaced from the charging hole.

BACKGROUND OF THE INVENTION

In the ideal case, the charging holes in the roof of a coke oven are equidistantly spaced and aligned in the travel direction of the coal-charging larry cart. The real conditions on a coke oven regularly deviate from this ideal case. In particular in older coke ovens, the position deviations of the charging holes in both axes are frequently ±50 mm, which may not be compensated for by centering aids typical in the art. This has the result that the charging hole lids may no longer be lifted automatically and later replaced automatically into the charging-hole jamb, and the charging-hole jamb cleaning also no longer functions satisfactorily. In coking-plant operation, interruptions arise in the automatic sequence of the coal-charging larry cart in this way and personnel-intensive interventions are necessary. Furthermore, charging-hole jambs on the roof must frequently be realigned, so that lid lifters and jamb cleaners may operate properly. Significant maintenance costs thus arise for the coking-plant operation.

A system that combines apparatuses for lifting lids out of charging holes and for cleaning the charging-hole jambs with a coal-charging apparatus having a horizontal conveyor screw with an outlet-side charging telescope to form an operating unit that is set up to be adjustable in two axes on the underside of a coal-charging larry cart is known from EP 1 293 552 B1. In these known systems, the horizontal conveyor screw is suspended on an positionable carriage that is guided on tracks on the underside of the coal-charging larry cart. The horizontal conveyor screw can move transversely to the tracks on profiled elements of the positioning carriage. The cover lifter and the jamb cleaner may adapt to the particular position of the charging holes in the roof of the coke oven by a dual-axis positioning of the operating unit. Using the known configuration, the lift magnet of the cover lifter and the cleaning head of the jamb cleaner may be brought into an operating position in which they align with the charging hole in the roof of the coke oven. However, this known configuration requires large vertical space below the coal outlet on the underside of the coal-charging larry cart, because the operating unit is attached on the intake-side end of the horizontal conveyor screw using a compensator that must make up for horizontally positioning the operating unit relative to two axes. This installation space is not always available. The known apparatus is not suitable or is only suitable with restrictions for retrofitting to existing coking installations.

OBJECT OF THE INVENTION

The object of the invention is to provide an apparatus having the purpose described above, that requires little space, may compensate for large position deviations of the charging holes, and that is suitable for retrofitting to existing coke oven.

SUMMARY OF THE INVENTION

Starting with an apparatus having the features described above, the object is attained according to the invention in that the carriage has a travel frame horizontally movable on rails on the underside of the coal-charging larry cart along a first axis and a support frame inside the travel frame, the support frame being guided for movement relative to the travel frame along a second axis transverse to the travel direction of the travel frame, the drive for the cover lifter and/or the jamb cleaner being mounted on the support frame). The support frame and the travel frame are horizontally movable independently of each other in directions perpendicular to each other. Position deviations of the charging-hole jamb may be compensated for by step-by-step and sequential movement of the travel frame and the support frame or by simultaneous positioning of these parts. The installation height of the carriage comprising travel frame and support frame is low, so that older coke ovens may also be retrofitted with the apparatus according to the invention.

The travel frame and the support frame are preferably generally coplanar. Such a configuration results in a very low overall height of the carriage comprising travel frame and support frame. The travel frame and the support frame are advantageously assembled from U-shaped elements, rollers which run in the U-shaped elements of the travel frame being mounted on the support frame. The travel frame is also equipped with rollers and runs in a track secured below the horizontal conveyor screw of the coal-charging larry cart. The rails for the travel frame preferably are U-shaped elements suspended using supports on the coal-charging larry cart and are laterally open. The rollers mounted on the travel frame engage in the U-shaped elements that are open on one side, and run in these rails.

Hydraulic drives are preferably used for horizontally positioning the support frame and the travel frame. According to a preferred embodiment of the invention, hydraulic drives equipped is with distance sensors are attached to the support frame and the travel frame.

A machine controller of the coal-charging larry cart is connected to the hydraulic drives and holds position data for the position of the charging openings in the roof of the coke oven. The deviations of the charging-hole jamb in the X and Y directions from the ideal position are detected using measuring technology at every charging-hole jamb and stored in the machine controller of the coal-charging larry cart. Because of the assignment of these deviations to each charging-hole jamb and each furnace chamber, the lid lifter and the jamb cleaner may be positioned by movements of the respective carriage in such a way that the lift magnet of the lid lifter and/or the cleaning head of the jamb cleaner are oriented centrally to the charging-hole jamb and may be lowered onto the cover and/or into the charging-hole jamb by a purely vertical movement. Pendulum movements and extreme inclined positions of the apparatus are eliminated so that all parts of the apparatus function optimally and the charging hole lid may be securely raised and/or inserted back into the frame and the charging-hole jamb may be cleaned reliably. Centering aids on the charging hole lids, which are typical in practice and represent a risk from the aspect of accident prevention, are eliminated. The dual-axis positioning of the carriage for the position correction of the lid lifter and the jamb cleaner may alternately already be performed during travel of the coal-charging larry cart or after positioning the coal-charging larry cart over the furnace chamber to be charged.

A further embodiment of the apparatus according to the invention provides that the hydraulic drives work together with an optical sensor carried on the coal-charging larry cart and detecting the actual position of the charging openings. The measurement data are relayed directly to the controller of the hydraulic cylinders that move the carriage of the lid lifter and the carriage of the jamb cleaner into a position corresponding to the location of the charging-hole jamb.

According to the invention the drives for the lid lifter and the jamb cleaner are fixed to the support frame of the respective carriage. The drive acting on the support frame is equipped with a distance sensor in this case and is activated in such a way that the lid lifter and/or the jamb cleaner is moved out of a rest position spaced from the charging hole into the operating position on the charging hole while taking the required corrections into consideration. The particular positioning movement is a function of the position deviations to be compensated for and may change from charging hole to charging hole. The correction movement and the movement of the lid lifter/jamb cleaner out of the rest position spaced from the charging hole into the operating position are preferably decoupled, however. In this case, the drives for the lid lifter and the jamb cleaner are each connected to a carriage movable along the profiled elements of the support frame inside the support frame of the respective carriage. The carriage is preferably movable transversely to the travel direction of the support frame, so that the travel movement of the running does not affect the position of the support frame. Hydraulic drives act on the carriage and are supported on the respective support frame and each move the lid lifter and the jamb cleaner using a permanently settable positioning movement between the operating position at a charging hole and a rest position spaced from the charging hole. In this embodiment, all correction movements in the X and Y directions and the travel movement between the rest position and the operating position are decoupled.

The carriages of the cover lifter and the jamb cleaner preferably each have a travel frame, the travel frames being physically spaced from and movable independently of each other. The spatial separation of the carriages allows a flexible adaptation to construction conditions, which is advantageous if older coking plants have to be retrofitted with the apparatus according to the invention. If the site conditions permit, a common travel frame may be used for the carriages. In this case, two alternatives result with regard to the support frame. According to a first embodiment, the support frames for the lid lifter and the jamb cleaner are movable independently of each other and may be positioned using separate positioning drives that are equipped with distance sensors inside the common travel frame. According to a second alternative embodiment, the lid lifter and the jamb cleaner are also mounted on a common support frame that is movable and may be exactly positioned using a positioning drive equipped with a distance sensor. The drives of the lid lifter and the jamb cleaner are mounted in this embodiment on separate carriages that are movable independently of each other inside the support frame.

BRIEF DESCRIPTION OF THE DRAWING

The invention is explained in greater detail hereafter on with reference to a drawing that only illustrates one embodiment.

DETAILED DESCRIPTION

The single FIGURE schematically shows an apparatus on the underside of a coal-charging larry cart shown schematically at 25 for raising lids 1 out of charging holes 2 in the roof 23 of a coke oven and for cleaning the charging-hole jambs 2. The basic construction of this apparatus includes a lid lifter 3 that has a is support arm 4 carrying a lift magnet 5, a jamb cleaner 6 that has a support arm 4' carrying a cleaning head 7, and drives 8, 8' for vertically positioning the support arms 4, 4'. The lid lifter 3 and the jamb cleaner 6 flank a charging unit 9 carried on the underside of the coal-charging larry cart 25 and comprising a horizontal screw conveyor 10 and a telescoping charging chute 11. The lid lifter 3 and the jamb cleaner 6 are each mounted on a respective carriage 12, 12' for horizontal movement between an operating position A in which the lift magnet 5 or the cleaning head 7 is aligned with a charging hole 13 in the roof 23 of the coke oven and a rest position B spaced from the charging hole 13.

The carriage 12 for the lid lifter 3 and the carriage 12' for the jamb cleaner 6 are of essentially identical construction. They each have a travel frame 15 that is horizontally movable on rails 14 on the underside of the coal-charging larry cart 25 along a first axis Y and a support frame 16 mounted inside the travel frame 15 and supported such that it is movable on the travel frame along a second axis X transverse to the travel direction defined by the axis Y of the travel frame 15. The drive 8 for the lid lifter 3 and the drive 8' for the cover cleaner 6 are mounted on the support frames 16 of the respective carriages 12, 12'.

It is obvious from the illustration that the travel frames 15 and the respective support frames 16 are generally coplanar. Both frames 15 and 16 are constructed from U-shaped elements. Rollers 17 that run in the U-shaped elements of the travel frame 15 are mounted on the support frame 16. The rails 14 for the travel frame 15 also comprise U-shaped elements suspended by supports 18 on the coal-charging larry cart 25 and are open horizontally. Rollers 19 that run in the laterally open rails 14 are mounted on the travel frame 15. The travel frames 15 and the is support frames 16 mounted inside the travel frames 15 form the carriages 12 and 12' that permit horizontal positioning in the X and Y directions of the respective arms 4 and 4'.

In the illustrated embodiment, the rails 14 for guiding the travel frame 15 extend in the travel direction of the coal-charging larry cart (Y direction), while the support frame 16 is guided transversely thereto in the direction of the furnace chamber axis (X axis) on the travel frame 15. This fixing is a function of site conditions. Depending on the construction conditions, it may be advantageous for the rails 14 carrying the travel frame 15 to extend parallel to the X axis and the support frame 16 to be movable in the Y direction.

Hydraulic drives 20 equipped with distance sensors are attached to the support frame 16 and the travel frame 15. A machine controller shown schematically at 24 of the coal-carrying larry cart 25 is connected to the hydraulic drives 20 and holds position data for the locations of the charging holes 13 in the roof 23 of the coke oven. Alternatively, the hydraulic drives 20 may work together with an optical sensor carried on the coal-charging larry cart 25 and detecting the position of the charging holes 13.

In the embodiment shown in the drawing, the drives 8, 8' of the lid lifter 3 and the jamb cleaner 6 are connected to respective carriages 21, 21' movable in the direction Y transversely to the travel direction X of the respective support frames 16 inside the support frames 16 of the respective carriages 12, 12' along the profiled elements of the support frames 16. Hydraulic drives 22 act on the carriages 21, 21', are supported on the respective support frame 16, and move the lid lifter 3 or the jamb cleaner 6 using a respective permanently settable positioning stroke a, b between the operating position A at a charging hole 13 and the rest position B spaced from the charging hole 13.

In the illustrated embodiment, the carriages 12, 12' for the lid lifter 3 and the jamb cleaner 6 each have a respective travel frame 15, the travel frames 15 being physically spaced from and movable independently of each other. If the site conditions permit it, the carriages 12, 12' may also have a common travel frame in which the support frames 16 for the lid lifter and the jamb cleaner are mounted and displaceable transversely to the travel direction of the travel frame.

The apparatus according to the invention allows a precise orientation of the lid lifter 3 and the jamb cleaner 6 on the charging holes 13 in the roof 23 of a coke oven and is capable of compensating for operationally related position deviations of the charging holes from a predefined basic position in the X and Y directions. In older coking plants, the position deviations may often be in the magnitude of ±100 to 150 mm along both axes X and Y. The horizontal position deviations of the charging-hole jambs 2 are measured in the longitudinal and transverse directions and stored for each charging-hole jamb 2 in the machine controller 24 on the coal-charging larry cart 25 and updated as needed. The coal-charging larry cart 25 is moved on the roof 23 of the coke oven and positioned at a predefined point corresponding to each of the charging holes 13 to charge a furnace chamber without taking the position deviations of the charging holes into consideration. The lid lifter 3 and the jamb cleaner 6 are then subsequently moved out of the rest position B spaced from the charging hole 13 into the operating position A adjacent the charging hole 13 and positioned with the aid of dual-axis compensation movements of the carriage 12, 12' in such a way that the lift magnet 5 of the lid lifter 3 and/or the cleaning head 7 of the jamb cleaner 6 are centered on the cover/charging-hole jamb 2. In a first step, the lift magnet 5 is lowered onto the charging hole lid and activated. The charging hole lid is raised out of the charging hole 13 and moved into the rest position B. In the next step, the cleaning head 7 of the jamb cleaner 6 is lowered into the charging-hole jamb 2 and the charging-hole jamb 2 is cleaned. After cleaning is ended and the jamb cleaner 6 has been moved back into its rest position, the charging telescope 11 is lowered and the coke oven chamber is charged with feed coal. After the charging procedure and after the charging hole lid has been reinserted by the lid lifter 3, the travel frames 15 of the carriages 12, 12' are moved back into their starting positions B, this procedure being able to be performed during travel of the coal-charging larry cart 25 to the coal tower. The lid lifter 3 and the jamb cleaner 7 are now again ready for a repositioning at the next furnace chamber to be charged.

The invention claimed is:

1. An apparatus on a coal-charging larry cart for lifting lids out of charging holes in the roof of a coke oven and for cleaning the charging-hole jambs, the apparatus comprising:

a lid lifter having a lifter support arm carrying a lift magnet;

a jamb cleaner having a cleaner support arm carrying a cleaning head;

lifter and cleaner travel frames respectively associated with the lid lifter and jamb cleaner and horizontally movable on rails on the underside of the coal-charging larry cart in a first horizontal travel direction;

a lifter support frame inside the lifter travel frame and movable relative to the lifter travel frame in a second horizontal travel direction transverse to the first travel direction of the lifter travel frame;

a cleaner support frame inside the cleaner travel frame and movable relative to the cleaner travel frame in the second horizontal travel direction;

a lifter carriage horizontally displaceable in the first travel direction on the lifter support frame and carrying the lifter support arm for horizontal movement of the lifter support arm relative to the respective lifter support frame between an operating position in which the lift magnet is aligned with a charging hole in the roof of the coke oven and a rest position spaced from the charging hole;

a cleaner carriage horizontally displaceable in the first travel direction on the cleaner support frame and carrying the cleaner support arm for horizontal movement of the cleaner support arm relative to the respective cleaner support frame between an operating position in which the cleaning head is aligned with a charging hole in the roof of the coke oven and a rest position spaced from the charging hole;

a vertical lifter drive for vertically moving the lid lifter with the lifter support arm relative to the respective lifter carriage; and a cleaner vertical drive for vertically moving the jamb cleaner with the cleaner support arm relative to the cleaner carriage, whereby the lid lifter and jamb cleaner can move in the first horizontal travel direction, the second horizontal travel direction and vertically independently of each other.

2. The apparatus according to claim 1, wherein the lifter and cleaner travel frames and the lifter and cleaner support frames are generally coplanar.

3. The apparatus according to claim 2, wherein the lifter and cleaner travel frames and the lifter and cleaner support frames are made of U-shaped elements and rollers that ride in the U-shaped elements of the lifter and cleaner travel frames are mounted on the respective lifter and cleaner support frames.

4. The apparatus according to claim 1, further comprising:

respective lifter and cleaner rails for the lifter and cleaner travel frames and made of horizontally open U-shaped elements suspended by supports from the coal-charging larry cart, and respective lifter and cleaner rollers that run in the respective horizontally open lifter and cleaner rails on the lifter and cleaner travel frames.

5. The apparatus according to claim 1, further comprising:

respective lifter and cleaner hydraulic drives equipped with distance sensors and attached to the lifter and cleaner support frames and to the respective lifter and cleaner travel frames.

6. The apparatus according to claim 5, further comprising:

a machine controller of the coal-charging larry cart, connected to the hydraulic drives, and holding data about the positions of the charging holes in the roof of the coke oven.

7. The apparatus according to claim 6, further comprising:

an optical sensor carried on the coal-charging larry cart and detecting the position of the charging holes and connected to the controller.

8. An apparatus on a coal-charging larry cart for lifting lids out of charging holes in the roof of a coke oven and for cleaning the charging-hole jambs, the apparatus comprising:

a lid lifter having a lifter support arm carrying a lift magnet;

a jamb cleaner having a cleaner support arm carrying a cleaning head;

lifter and cleaner travel frames respectively associated with the lid lifter and jamb cleaner and horizontally movable on rails on the underside of the coal-charging larry cart in a first horizontal travel direction;

a lifter support frame inside the lifter travel frame and movable relative to the lifter travel frame in a second horizontal travel direction transverse to the first travel direction of the lifter travel frame;

a cleaner support frame inside the cleaner travel frame and movable relative to the cleaner travel frame in the second horizontal travel direction;

a lifter carriage horizontally displaceable in the first travel direction on the lifter support frame and carrying the lifter support arm for horizontal movement of the lifter support arm relative to the respective lifter support frame between an operating position in which the lift magnet is aligned with a charging hole in the roof of the coke oven and a rest position spaced from the charging hole;

a cleaner carriage horizontally displaceable in the first travel direction on the cleaner support frame and carrying the cleaner support arm for horizontal movement of the cleaner support arm relative to the respective cleaner support frame between an operating position in which the cleaning head is aligned with a charging hole in the roof of the coke oven and a rest position spaced from the charging hole;

a vertical lifter drive for vertically moving the lid lifter with the lifter support arm relative to the respective lifter carriage; and a cleaner vertical drive for vertically moving the jamb cleaner with the cleaner support arm relative to the cleaner carriage;

a lifter drive for the lid lifter and connected between the lifter support frame and the lifter carriage; and a cleaner drive for the jamb cleaner and connected between the cleaner support frame and the cleaner carriage, whereby the lid lifter and jamb cleaner can move in the first horizontal travel direction, the second horizontal travel direction and vertically independently of each other.

9. The apparatus according to claim 8 wherein the lifter and cleaner drives that act on the respective lifter and cleaner carriages are supported on the respective lifter and cleaner support frames and move the lid lifter and the jamb cleaner using a permanently settable positioning stroke between the respective operating position at a charging hole and the respective rest position spaced from the charging hole.

10. The apparatus according to claim 9, wherein the lifter and cleaner support frames are movable independently of each other and may be positioned by separate respective positioning drives equipped with distance sensors.

* * * * *